United States Patent [19]

Lenderink

[11] Patent Number: 4,844,304

[45] Date of Patent: Jul. 4, 1989

[54] TOY CAPABLE OF FLIGHT

[76] Inventor: Trent A. Lenderink, 1271 House St., Belmont, Mich. 49306

[21] Appl. No.: 128,347

[22] Filed: Dec. 3, 1987

[51] Int. Cl.[4] ..... F41B 7/02

[52] U.S. Cl. ..... 273/428; 124/18

[58] Field of Search ..... 273/428, 420; 124/18, 124/19

[56] References Cited

U.S. PATENT DOCUMENTS

| | | | |
|---|---|---|---|
| 1,424,674 | 8/1922 | Orr | 273/420 |
| 1,768,944 | 7/1930 | Taylor | 124/18 |
| 1,957,713 | 5/1934 | Howe | 124/18 |
| 3,746,334 | 7/1973 | Stubblefield | 273/420 X |
| 3,965,882 | 6/1976 | Ehrens et al. | 124/18 |
| 4,324,220 | 4/1982 | Joelson | 124/18 |

FOREIGN PATENT DOCUMENTS

| | | | |
|---|---|---|---|
| 2507950 | 9/1976 | Fed. Rep. of Germany | 273/420 |

*Primary Examiner*—Paul E. Shapiro

*Attorney, Agent, or Firm*—Price, Heneveld, Cooper, DeWitt & Litton

[57] ABSTRACT

A toy, designed for throwing, has an elongated, flexible tubular body with a weight at its forward end encased in an impact-absorbing jacket and a conical, flared tail element providing both a grip for the user and an air-foil type direction stabilizer during flight.

12 Claims, 2 Drawing Sheets

TOY CAPABLE OF FLIGHT

FIELD OF THE INVENTION

This invention relates to amusement devices and more particularly to a toy designed to be thrown.

BACKGROUND OF THE INVENTION

Toys so designed that they can be thrown or projected at a target are ancient forms of amusement devices and some have become serious hunting tools such as slingshots and the boomerang. It is an old and simple form of toy to tie a length of string to a small weight such as the nut of the horse chestnut tree, whirl it to obtain speed, and then release it toward a target. Of generally the same principle was the stone throwing sling of Biblical fame. All of these devices depend entirely upon the accuracy of a trajectory at release and the mass-energy of the thrown object to maintain the trajectory. None of these devices provides a projectile type of device having an elastic energy source combined with an end portion incorporating a major portion of the projectile's mass density at the rear end at the time of initiation of release coupled with an end for end reversal at the point of final release.

BRIEF DESCRIPTION OF THE INVENTION

The invention provides a toy having an elongated, elastic body with head and tail portions with the tail portion providing both a grip suitable to be held, such as between the thumb and the forefinger and also a guide or flight stabilizer after release. The device is designed to be energized by stretching the body of the projectile with the end having the major mass density being held at the rear until release. Upon release, the ends reverse position with the heavier mass density end assuming the lead position and the formerly front end assuming the rear stabilizing position.

DESCRIPTION OF THE PREFERRED EMBODIMENT

Figure 1:
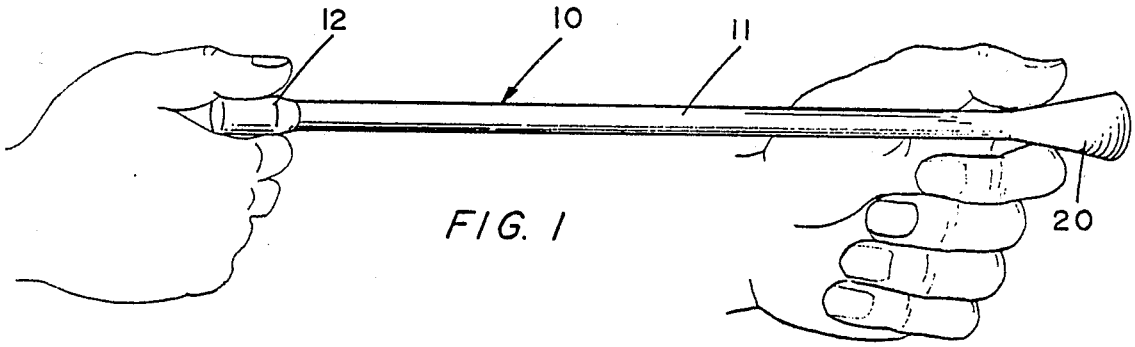
FIG. 1 illustrates the position of the toy when stretched just prior to release.

The toy 10 has an elongated body 11 of a flexible tubular material such as rubber. Any flexible, rubber-like resilient material, such as latex or urethane, can be used to provide the body. A material which has proven to be effective for making the body is latex, surgical grade tubing such as the product offered by Primeline Industries, Inc. of Cuyahoga Falls, Ohio having a colored latex outer cover. Such tubing having a 3/16 of an inch inside diameter opening and a wall thickness of 3/32 of an inch provides an effective body for the toy. This tubing has a durometer hardness, Shore A Scale of 35±5. The outer surface forms a flexible jacket which can be colored to provide visibility.

The forward end or head 12 is enlarged and has an insert 13 serving as a weight providing a significant portion of the mass density of the toy. A short length of wooden dowel will provide adequate weight. However, for more sustained flight and greater accuracy a heavier weight may be substituted such as one of iron or lead. The weight is pressed into the end of the tubular body and expands it. It may be bonded to the body 11, but normally this is not necessary because of the high frictional gripping characteristic of the tubing. However, it is important that the insert 13 be positively held against dislodgement, even under sudden acceleration, as will be evident when studying the end for end maneuver illustrated in FIGS. 1–3 at the time of launch. After the weight 13 has been installed, the enlarged end is encased in a jacket 14. The jacket caps the open end of the tube and is tapered in thickness to nothing at the base of the enlarged forward end. It is also firmly bonded to the tubular body 11. The jacket can be formed by repeated dipping of the forward end in a liquid rubber coating suitable for air drying and thereby forming the final head. The jacket is built up to the desired thickness by repeated dipping into the liquid material. A suitable material for this purpose is a flexible, air dryable rubber coating marketed by PDI, Inc. of St. Paul, Minn. under the trademark "Plastic Dip". Preferably, the weight or insert 13 is recessed a short distance into the end of the body leaving a gap 15 between it and the end of the tubing. During the dipping to form the jacket, the viscosity of the liquid into which the head is dipped is such as to completely bridge the open end of the tube preserving the space 15 between the jacket 14 and the end of the insert 13. This provides a further cushioning effect when the head impacts an object. The jacket adds a degree of resiliency which negates or at least reduces injury to a person or target struck by the toy. The weight of the jacket provides momentum at the lead end of the toy increasing its stability in flight. It also provides the momentum necessary to assure an effective length of flight.

The rear end of the toy is also flared out to form a generally conical tail section 20. The diameter of the tail section 20 progressively increases toward the rear end of the toy creating a grip to be used when the body is being stretched. The shape of the tail section is created by a rigid conical insert 21 inserted into the end of the tubular body and secured by suitable means such as bonding. The insert 21 should be lightweight and rigid. Rigidity is essential to prevent the tail from being crushed or deformed by the user exerting sufficient gripping pressure for holding the toy while it is being stretched. It is also important that the tail 20 be lightweight so it easily remains aligned with the head 12 and the intervening body of the toy. It has been found that a solderless, twist-on connector for electrical wires makes a satisfactory insert 21 for the tail. When using tubing of the size previously described, a connector for #22 wire has been found to be satisfactory. It is lightweight, crush resistant and provides both the desired taper and the proper length for the tail section. In a toy having the head and tail characteristics described, a length, when relaxed, of 13 inches for the tubular body has proven satisfactory.

Figure 2:
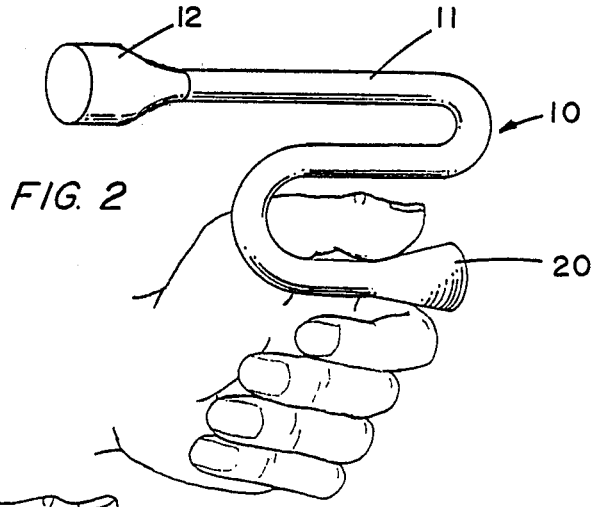
FIG. 2 illustrates the toy during end for end reversal immediately after release of the heavy end.
Figure 3:
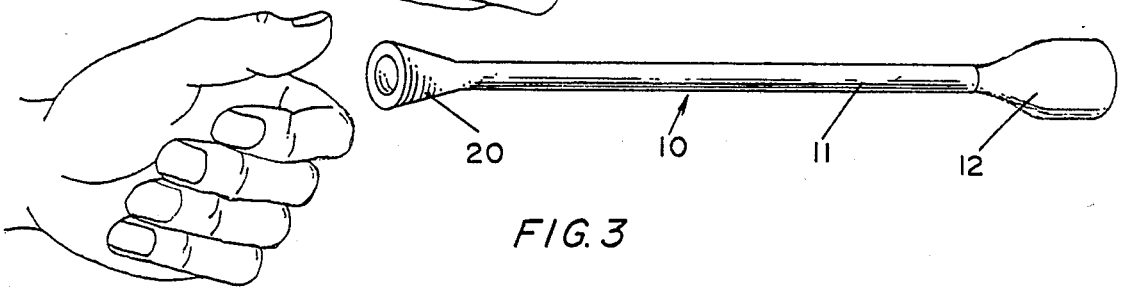
FIG. 3 illustrates the toy immediately after final release.

The tubular body 11 must be both flexible and resilient. To prepare the toy for flight, the body of the toy is stretched. One way of doing this is to grasp the tail section between the thumb and forefinger of one hand and the head with the other hand and stretch the body 11 to energize it (FIG. 1). When the body has been sufficiently stretched and properly aimed, the head is released and immediately initiates an end for end reversal in position until the mass of the head assumes the lead position (FIGS. 2 and 3). Just before the head and tail sections become aligned the grip on the tail section is released leaving the body 11, head 12 and tail section 20 aligned and travelling the selected trajectory (FIG. 3). The combination of locating the major mass in the head section and guidance provided by the conically flared tail section 20 induces the flexible body 11 to remain straight and therefor develop a flight path capable of responding to accurate aiming and substantial range.

The tapered tail structure makes it possible to maintain a positive grip on the toy with a minimum of gripping pressure, using only the thumb and forefinger. This greatly facilitates gripping the toy and precisely timing the act of release.

The conically flared tail is also important after release. Its shape permits it to have an air foil function, keeping the tail aligned with the direction of flight of the head. Thus, rather than tending to drift horizontally or vertically, it tends to keep the body 11 aligned in the flight path determined at the point of release, enabling the toy to reach its target.

Figure 4:
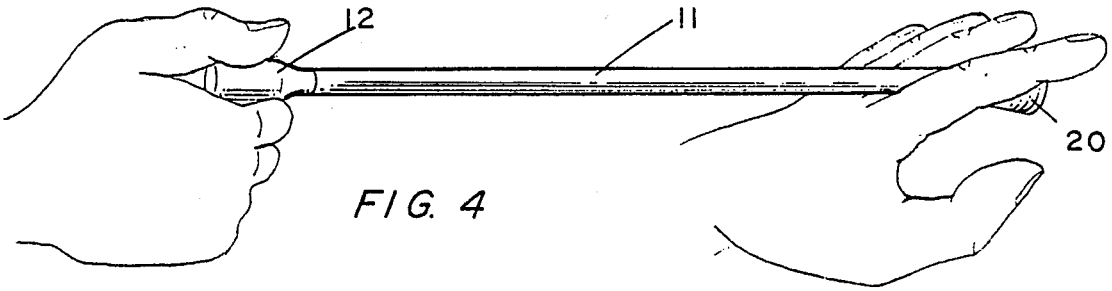
FIG. 4 illustrates an alternative method of holding the toy while tensioning it.

FIG. 4 illustrates an alternate method of holding the toy using only the hands. In this case, the tail end 20 is held between the index and middle fingers with the hand substantially parallel to the plane of flight. This permits the momentum of the head 12 and trailing body to lift the tail end 20 from between the fingers with only slight loss of velocity.

Figure 5:
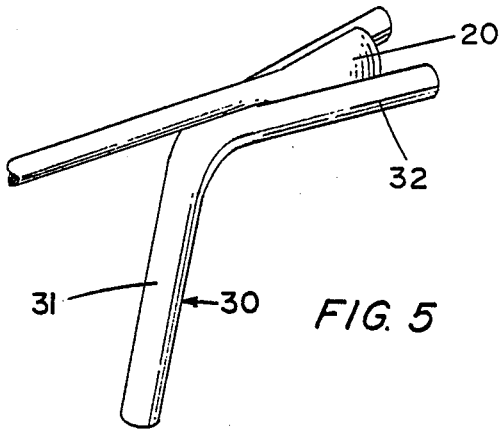
FIG. 5 illustrates the method shown in FIG. 4 in which a holder has been substituted for one of the user's hands.

FIG. 5 illustrates a launching tool 30 having a handle 31 and a crotch or forked grip 32 which simulates the fingers as the toy is held in the technique illustrated in FIG. 4. The grip 32, like the fingers of the operator's hand in FIG. 4, is inclined at an angle parallel with the desired plane of flight of the toy. The grip is so designed that it will engage and hold the enlarged tail end 20 of the toy.

Figure 6:
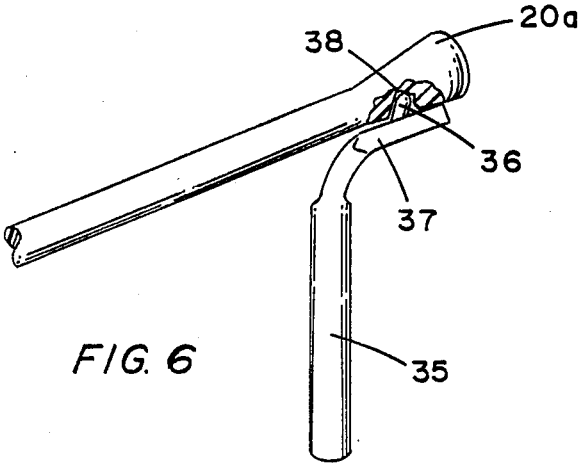
FIG. 6 illustrates a modified holder for the toy.
Figure 7:
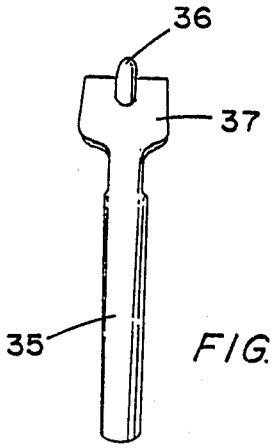
FIG. 7 is a rear view of the holder shown in FIG. 6.
Figure 8:
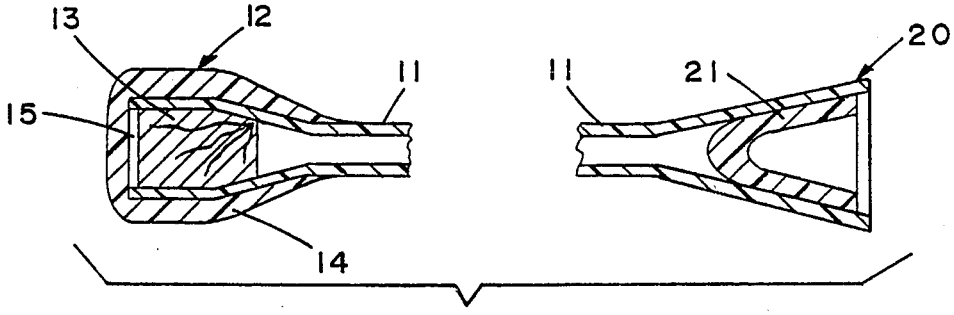
FIG. 8 is an enlarged fragmentary central sectional view of the toy.

FIGS. 6 and 7 illustrate a further modification in which the launching tool 35 has a central pin 36 projecting a short distance above the surface of the head 37 of the tool. The pin is inclined upwardly and outwardly in the direction of flight of the toy. To use this launcher, the tail portion 20*a* has an opening 38 to receive the pin. The opening 38 is so shaped that the toy will be released from the pin without any binding action due to the tail portion's direction reversal as it is withdrawn from the launching tool 35.

The tubular body can have a colored exterior jacket to increase visibility. This jacket could incorporate a fluorescent material to improve visibility.

The particular size of the toy which has been described is a preferred embodiment. It could be made larger or smaller. For example, experiments indicate that the body will function with a length of 17 inches or as little as 9 inches. The tubing diameter can range from 7/16 of an inch down to 3/16 inch when making the smaller length toy. The size of the head and tail inserts 13 and 21 would be adjusted accordingly to remain in proportion to the size and length of the body. Also, the materials selected for the inserts 13 and 21 can be varied without changing the invention provided, however, that the dominant weight controlling the momentum and trajectory of the toy remains at the head end of the toy.

Having described a preferred embodiment and some modifications of my invention, it will be recognized that various other modifications of it can be made without departing from the principles of the invention. Such modifications are to be considered as included in the hereinafter appended claims unless these claims, by their lauguage, expressly state otherwise.

The embodiments of the invention in which an exclusive property or privilege is claimed are defined as follows:

1. A toy having an elongated flexible tubular body of elastic material, a weight inserted in and secured to the forward end of said body said weight constituting a substantial portion of the weight of the toy; said body having a tail end, insert means mounted in said tail end, said insert means being conical and imparting a conical shape to the exterior surface of said tail end whereby said tail end is of progressively increasing diameter toward the toy's rear end.

2. A toy as described in claim 1 wherein said forward end is encased in a resilient jacket.

3. A toy as described in claim 2 wherein said insert means for the tail end is a rigid molded plastic shell bonded to said body.

4. A toy as described in claim 3 wherein said body is sufficiently flexible to be bent through an arc of approximately 180° during the acceleration period initiating its flight.

5. A toy as described in claim 2 wherein a space is provided between the forward end of said weight and the inner face of said jacket.

6. A toy as described in claim 1 wherein said weight is a wooden plug.

7. A toy as described in claim 6 wherein said forward end is encased in a resilient jacket, a space being provided between the end of said plug and the inner face of said jacket to provide increased cushioning when the toy impacts against an object.

8. A toy as described in claim 1 wherein the weight is a metal plug.

9. A toy as described in claim 1 wherein said weight constitutes a major and dominant portion of the energy of the toy after it has been accelerated to flight speed.

10. A toy as described in claim 1 wherein said body is encased in a flexible outer skin having a bright coloring.

11. A toy as described in claim 10 wherein said coloring includes a material which fluoresces.

12. The method of causing the toy described in claim 1 to traverse a flight trajectory including the steps of grasping the conical tail end of the body between the thumb and forefinger, and simultaneously grasping the forward end of the toy stretching the toy's body by increasing the distance between the ends thereof to provide tension between its ends, releasing the forward end of the toy and allowing the forward end to double back on itself and as the doubled back loop formed thereby approaches said tail end thereof releasing said tail end.

* * * * *